US008840158B2

(12) United States Patent
Leibovitz

(10) Patent No.: US 8,840,158 B2
(45) Date of Patent: Sep. 23, 2014

(54) LIFTING BEAM

(76) Inventor: Eitan Leibovitz, Even Yehudah (IL)

( * ) Notice: Subject to any disclaimer, the term of this patent is extended or adjusted under 35 U.S.C. 154(b) by 0 days.

(21) Appl. No.: 14/001,846

(22) PCT Filed: Feb. 27, 2012

(86) PCT No.: PCT/IB2012/050881

§ 371 (c)(1),
(2), (4) Date: Sep. 23, 2013

(87) PCT Pub. No.: WO2012/114319

PCT Pub. Date: Aug. 30, 2012

(65) Prior Publication Data

US 2014/0001782 A1 Jan. 2, 2014

Related U.S. Application Data

(60) Provisional application No. 61/447,054, filed on Feb. 27, 2011.

(51) Int. Cl.
*B66C 1/10* (2006.01)

(52) U.S. Cl.
CPC ..... *B66C 1/105* (2013.01)
USPC ..... 294/67.5; 294/81.3

(58) Field of Classification Search
USPC ..... 294/67.5, 81.3, 67.1, 67.21; 414/469, 414/482, 483, 779, 782, 776
See application file for complete search history.

(56) References Cited

U.S. PATENT DOCUMENTS

| | | | | | |
|---|---|---|---|---|---|
| 2,851,170 | A * | 9/1958 | McDonough | 414/10 |
| 3,675,961 | A * | 7/1972 | Wheeler | 294/67.1 |
| 3,868,139 | A * | 2/1975 | Drelicharz | 294/81.4 |
| 3,998,488 | A * | 12/1976 | Durgan | 294/67.21 |
| 4,245,941 | A * | 1/1981 | Charonnat | 294/81.3 |
| 4,251,098 | A * | 2/1981 | Belinsky | 294/67.21 |
| 4,843,200 | A * | 6/1989 | Parlatore et al. | 200/553 |
| 5,431,470 | A * | 7/1995 | Magerl et al. | 294/67.2 |
| 6,048,012 | A * | 4/2000 | Selby et al. | 294/81.3 |
| 7,017,963 | B1 | 3/2006 | Setzke et al. | |
| 7,229,109 | B2 * | 6/2007 | Leibovitz | 294/67.5 |
| 8,317,244 | B1 * | 11/2012 | Schuyleman | 294/67.5 |
| 2011/0036043 | A1 * | 2/2011 | Heinaman | 52/741.1 |

* cited by examiner

*Primary Examiner* — Paul T Chin
(74) *Attorney, Agent, or Firm* — Patwrite Law; Mark David Torche

(57) ABSTRACT

A lifting beam for lifting a load. The lifting beam comprises: an elongated beam; a load balancing mechanism movably associated with the elongated beam and having a horizontal arm and a counterweight attachment element, from which a counterweight can be hung; a lifting ring connected to the elongated beam from which the lifting beam can be hung; and a load attachment mechanism whereby the load is attachable to the lifting beam, wherein the load balancing mechanism further comprises a counterweight movement apparatus adapted to move the counterweight along the elongated beam in order to help balance the load, and the elongated beam has a series of micro-switches along a bottom surface thereof the micro-switches arranged whereby an end of the horizontal arm will contact one of the switches in the case of undue tilting of the lifting beam.

5 Claims, 3 Drawing Sheets

LIFTING BEAM

CROSS-REFERENCE TO RELATED PATENT APPLICATIONS

This application claims priority from U.S. provisional patent application 61/447,054, entitled "Lifting beam", filed on Feb. 27, 2011, the entire contents of which are incorporated herein by reference.

FIELD OF THE INVENTION

The present invention relates to hoisting equipment.

BACKGROUND OF THE INVENTION

Cranes are commonly used for hoisting construction material and equipment at construction sites. Typically, cranes are limited to locations where there is a free vertical line between the hook of the crane and the location where the lifted load is placed.

At some construction sites there may be a need to place a load on a floor where a ceiling to that floor or other such obstruction exists, such as in a building. In such a case, it may be beneficial to lift the load vertically by the crane, and then shift the load sideways, horizontally, into the building, through the space formed between the floor and the associated ceiling.

U.S. Pat. No. 7,017,963 to Setzke et al. discloses a counter weighted lifting beam for enabling the lifting task described above, wherein a counterbalanced lifting beam is designed to lift and permit balancing of heavy loads. The lifting beam includes an internal counterweight that is adapted to be hydraulically adjusted by use of a manually operated control mechanism. The lifting beam also includes a rigid elongated lifting tower.

It is an object of the present invention to provide a lifting beam that may be easily adjusted to lift various loads that have significantly different weights.

It is a further object of the present invention to provide a lifting beam designed to eliminate or at least reduce the chance of the beam turning over when the beam carries an unbalanced load.

SUMMARY OF THE INVENTION

The present invention relates to a lifting beam having a counterweight that is movable to mitigate balancing issues when lifting/moving a load.

In accordance with embodiments of the present invention there is provided a lifting beam as defined in claim 1 and its dependent claims.

BRIEF DESCRIPTION OF THE DRAWINGS

The present invention will be understood and appreciated more fully from the following detailed description taken in conjunction with the appended drawings in which.

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DESCRIPTION OF EMBODIMENTS OF THE INVENTION

Illustrative embodiments of the invention are described below. In the interest of clarity, not all features/components of an actual implementation are necessarily described.

Figure 1:
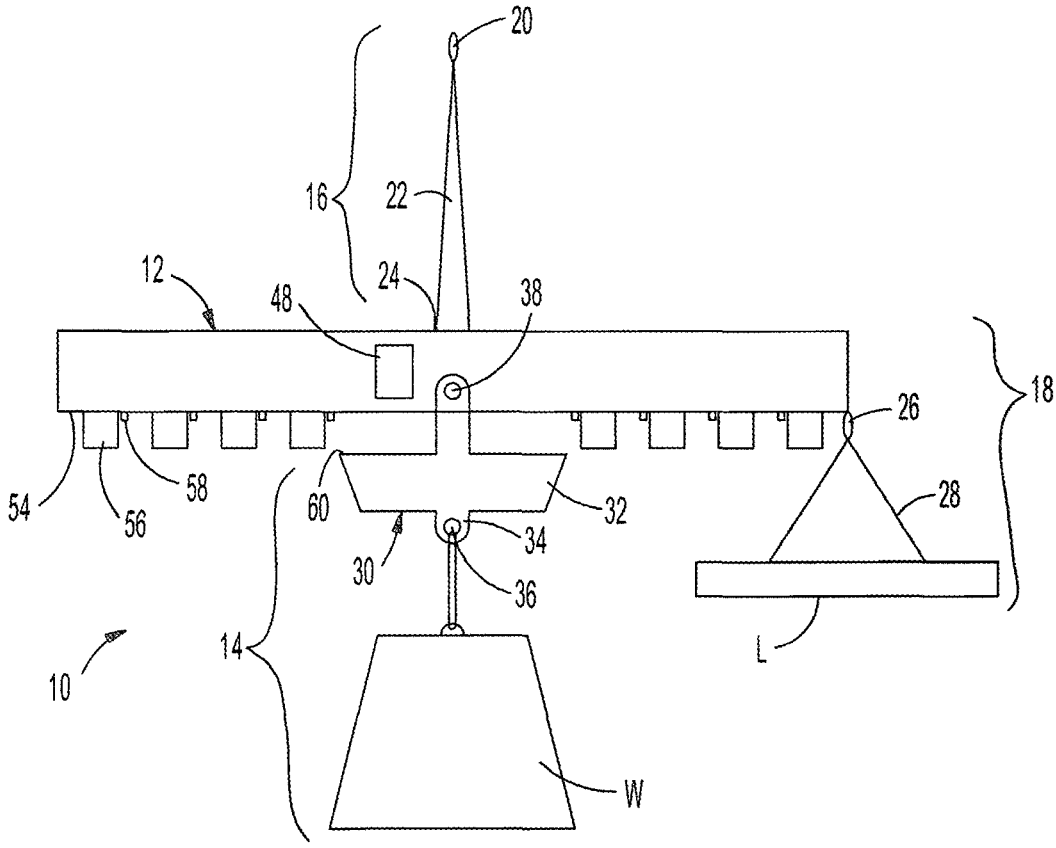
FIG. 1 is a schematic side view of an embodiment of a lifting beam according to the present invention.

FIG. 1 shows an embodiment of a lifting beam 10 in accordance with the present invention, for lifting a load L. Lifting beam 10 includes an elongated beam 12; a load balancing mechanism 14 movably associated with the elongated beam; a lifting attachment mechanism 16 whereby the lifting beam can be lifted and carried by a crane or the like; and a load attachment mechanism 18 for attaching/carrying load L to the lifting beam.

Lifting attachment mechanism 16 typically includes components such as a lifting ring 20 and a ring-to-beam connector 22, which is usually connected at or near a midpoint 24 of elongated beam 12. Load attachment mechanism 18 includes, for example, an eyelet 26 and load attachment straps 28.

Load balancing mechanism 14 includes a beam stabilizing member 30, which has a relatively long horizontal arm 32 and a relatively short vertical arm 34 that typically cross each other. Vertical arm 34 has a counterweight attachment element, for example a hook or an eyelet 36 whereat a counterweight W can be attached/hung. Prior to attaching load L to lifting beam 10, counterweight W is typically located below midpoint 24 of elongated beam 12, as shown in FIG. 1.

Figure 2:
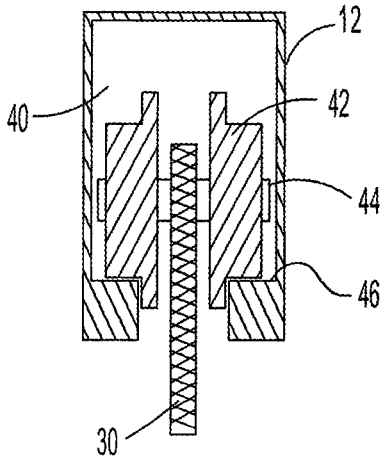
FIG. 2 is a schematic side view of the lifting beam of FIG. 1.

With reference also to FIG. 2, vertical arm 34 has a similar attachment element 38 (which allows pivoting of beam stabilizing member 30) for connection to additional components of load balancing mechanism 14, for moving the counterweight W to balance load L. As seen in FIG. 2, elongated beam 12 has an upside down U-shape defining a channel 40. The aforementioned additional load balancing components are substantially disposed in channel 40 and include one or more set of wheels 42, including an axle 44 for each set of wheels. Elongated beam 12 has shoulders 46 upon which wheels 42 are rollable.

Reverting to FIG. 1, load balancing mechanism 14 further includes a motor 48 for load balancing mechanism 14, in particular for rotating wheels 42 to move counterweight W in order to balance load L. For clarity, motor 48 is not shown in FIG. 2.

Figure 3:
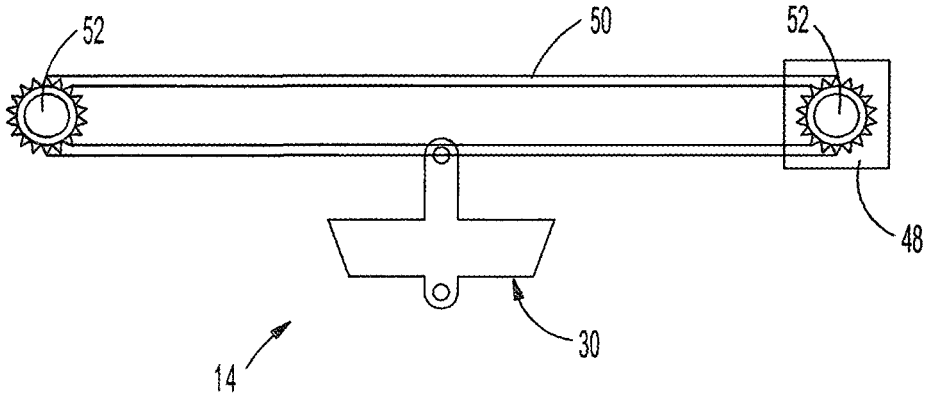
FIG. 3 is a schematic end view of the lifting beam of FIG. 1.

FIG. 3 illustrates an exemplary modified load balancing mechanism 14 wherein instead of wheels 42, the mechanism includes a chain 50 supported at both ends thereof by, and engaged with, a pair of gears or chain wheels 52 that are attached to elongated beam 12. One of chain wheels 52 is rotatable by motor 48.

Motor 48 is preferably provided with a double braking mechanism. When motor 48 is rotating one of chain wheels 52 the wheel's gear is locked when the motor is no longer activated. Furthermore, when the motor 48 is no longer activated, an external brake (not shown) presses against the motor's shaft preventing any possible rotation of wheels 42 or chain wheel 52.

Operation: Load L (via load attachment mechanism 18) and a crane or the like (via lifting attachment mechanism 16)

are attached to lifting beam 10. As the crane lifts lifting beam 10, the lifting beam will become weighted and tip toward load L. At this point, motor 48 is activated (e.g. by a worker, or optionally by a level switch, not shown) so that load balancing mechanism 14 together with counterweight W are moved in the direction away from load L, until elongated beam 12 becomes essentially level. At this point, lifting beam 10, together with load L, is ready to be lifted to a desired floor or other such location.

When the load L is opposite the desired location, such as a building floor, the crane can be moved to displace the load horizontally to the selected floor and placed thereon in the desired position. As load L is rested on the floor, motor 48 is again operated, however this time to move counterweight W toward beam midpoint 24 so the load can be safely detached.

It is a particular feature of the present invention that lifting beam 10 comprises a load balancing mechanism 14 adapted, as described in embodiments above, so that counterweight W can be conveniently changed out with a counterweight having a different mass (weight) so the lifting beam can be used for different sized loads, in contrast to designs where there is a counterweight internal to the beam, which is not conveniently replaceable/exchangeable. This exchange-ability is a very cost-effective feature as it prevents the need to replace the entire lifting beam, or complicated and time consuming replacement of the internal counterweight as may be necessary with prior art lifting beams.

Figure 4:
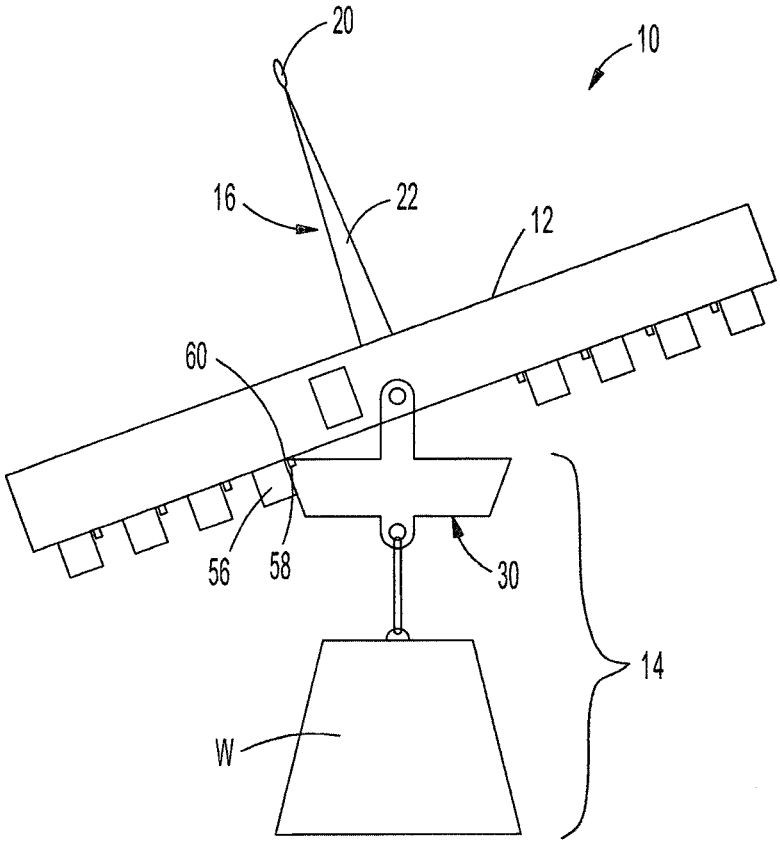
FIG. 4 is a schematic side view of the lifting beam in the event of a significant tipping of the beam.

FIG. 4 shows another particular feature of the present invention wherein lifting beam 10 comprises a mechanism for preventing significant tilting of elongated beam 12 during use. In order to prevent a significant unbalance or worse yet turnover of lifting beam 10, a lower surface 54 of beam 12 includes a series of micro-switches 58. Each of micro-switches 58 is located near a mechanical stop 56.

In a case of an undesired inclination of the beam 12, e.g., over 10% or 20% from the horizontal, due to a human error, etc, in operating motor 48, a chain breakage, a load slippage, etc., elongated beam 12 may tilt to a position shown in FIG. 4. In this position, since horizontal arm 32 of stabilizing beam 12 remains in a horizontal position due to the non-rigid (pivotable) connection of the horizontal arm 32 via attachment element 38 and the downwardly directed force applied by counterweight W, an end 60 of the horizontal arm 32 presses against an adjacent micro-switch 58 thus causing the motor 48 to stop functioning and preventing additional tilting of the beam 12. In a case were the function of micro-switch 58 is not enough, end 60 of the horizontal arm 32 wedges against the adjacent mechanical stop 56 whereby elongated beam 12 is firmly kept in this position. Additionally or alternatively, micro-switch 58 can be adapted to provide a signal to stop the lifting activity. At this point, if necessary, lifting beam 10 may be safely lowered to ground and the malfunction may be remedied. Thus, the structure of lifting beam 10 according to the present invention helps prevent an unbalanced turnover of the lifting beam.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

The invention claimed is:

1. A lifting beam for lifting a load, the lifting beam comprising:

an elongated beam having a first end, a second end and a midpoint;

a load balancing mechanism movably associated with the elongated beam and having a horizontal arm and a counterweight attachment element, from which a counterweight can be hung;

a lifting ring connected to the elongated beam from which the lifting beam can be hung; and a load attachment mechanism whereby the load is attachable to the lifting beam, wherein the load balancing mechanism further comprises a counterweight movement apparatus adapted to move the counterweight along the elongated beam in order to help balance the load, and the elongated beam has a series of micro-switches along a lower surface thereof the micro-switches arranged whereby an end of the horizontal arm will contact one of the micro-switches in the case of undue tilting of the lifting beam.

2. The lifting beam according to claim 1, wherein the load balancing mechanism is adapted so that the counterweight can be replaced with a different counterweight.

3. The lifting beam according to claim 1, wherein the load balancing mechanism comprises a chain and a motor for moving the counterweight.

4. The lifting beam according to claim 1, wherein the load balancing mechanism comprises wheels for moving the counterweight.

5. The lifting beam according to claim 1, wherein the elongated beam further comprises mechanical stops adjacent the micro-switches.

* * * * *